US011568764B2

(12) United States Patent
Franko, Jr. et al.

(10) Patent No.: US 11,568,764 B2
(45) Date of Patent: Jan. 31, 2023

(54) RESEALABLE RECLOSURE LABEL WITH INTEGRAL HINGE

(71) Applicant: Lux Global Label Company, LLC, Lafayette Hill, PA (US)

(72) Inventors: Joseph D Franko, Jr., Moorestown, NJ (US); Zach Witwer, Souderton, PA (US); Neil Sellars, Cinnaminson, PA (US); Jason Doern, Harleysville, PA (US)

(73) Assignee: Lux Global Label Company, LLC, Lafayette Hill, PA (US)

( * ) Notice: Subject to any disclaimer, the term of this patent is extended or adjusted under 35 U.S.C. 154(b) by 63 days.

(21) Appl. No.: 17/109,638

(22) Filed: Dec. 2, 2020

(65) Prior Publication Data

US 2022/0168988 A1 Jun. 2, 2022

(51) Int. Cl.
*G09F 3/02* (2006.01)

(52) U.S. Cl.
CPC ..... *G09F 3/02* (2013.01); *G09F 2003/0241* (2013.01); *G09F 2003/0257* (2013.01); *G09F 2003/0272* (2013.01); *Y10T 428/14* (2015.01)

(58) Field of Classification Search
CPC ..... G09F 3/02; G09F 2003/0241; G09F 2003/0257; G09F 2003/0272; Y10T 428/14
See application file for complete search history.

(56) References Cited

U.S. PATENT DOCUMENTS

| | | | | |
|---|---|---|---|---|
| 6,026,953 | A | 2/2000 | Nakamura et al. | |
| 6,420,006 | B1 | 7/2002 | Scott | |
| 6,428,867 | B1 | 8/2002 | Scott et al. | |
| 6,589,622 | B1 | 7/2003 | Scott | |
| 6,767,604 | B2 | 7/2004 | Muir et al. | |
| 7,007,423 | B2 | 3/2006 | Andersson et al. | |
| 7,703,602 | B2 | 4/2010 | Saito et al. | |
| 7,842,365 | B2 | 11/2010 | Riggs | |
| 8,114,451 | B2 | 2/2012 | Sierra-Gomez et al. | |
| 8,182,891 | B2 | 5/2012 | Scott et al. | |
| 9,475,615 | B2 | 10/2016 | Schiermeier et al. | |
| 2017/0021974 | A1 | 1/2017 | Lemmons et al. | |
| 2018/0186537 | A1* | 7/2018 | Konicke | B65D 25/205 |

FOREIGN PATENT DOCUMENTS

| | | | | |
|---|---|---|---|---|
| EP | 3050820 | A1 * | 8/2016 | B65D 43/161 |

* cited by examiner

*Primary Examiner* — Patricia L. Nordmeyer

(57) ABSTRACT

Techniques regarding a reclosure label are provided. For example, one or more embodiments described herein can comprise a reclosure label that includes a flap portion connected to a label base. Further, the flap portion can comprise a rigid material layer. Additionally, the reclosure label can comprise a flexible material layer that is integral with the flap portion and the label base and forms a hinge portion that enables the flap portion to pivot with respect to the label base. Moreover, the rigid material layer can be absent from the hinge portion.

20 Claims, 10 Drawing Sheets

RESEALABLE RECLOSURE LABEL WITH INTEGRAL HINGE

BACKGROUND

The subject disclosure relates to a reclosure label that can cover an opening in a product package, and more specifically, to a multi-layered reclosure label with an integral hinge than facilitates repeated opening and closing of the reclosure label with respect to the package opening.

SUMMARY

The following presents a summary to provide a basic understanding of one or more embodiments of the invention. This summary is not intended to identify key or critical elements, or delineate any scope of the particular embodiments or any scope of the claims. Its sole purpose is to present concepts in a simplified form as a prelude to the more detailed description that is presented later. In one or more embodiments described herein apparatuses and/or devices regarding embodiments of a reclosure label are described.

According to an embodiment, a reclosure label is provided. The reclosure label can comprise a flap portion connected to a label base. The flap portion can comprise a rigid material layer. The reclosure label can also comprise a flexible material layer that is integral with the flap portion and the label base and forms a hinge portion that enables the flap portion to pivot with respect to the label base. The rigid material layer can be absent from the hinge portion.

According to another embodiment, a reclosure label is provided. The reclosure label can comprise a flexible material layer comprised within a flap portion of the reclosure label and a label base of the reclosure label. A portion of the flexible material layer can form a hinge between the flap portion and label base. Further, a first surface of the flexible material layer can be at least partially coated with an adhesive that permits repeated adhesion and separation of the flap portion to a package. Additionally, the reclosure label can comprise a rigid material layer comprised within the flap portion and adhered to a second side of the flexible material layer, where the second side can be opposite the first side.

According to a further embodiment, a reclosure label is provided. The reclosure label can comprise a flexible material layer comprised within a flap portion of the reclosure label and a label base of the reclosure label. A portion of the flexible material layer can form a hinge between the flap portion and label base. Also, the reclosure label can comprise a rigid material layer having a first surface adhered to the flexible material layer within the label base. Also, the reclosure label can comprise a release layer positioned between the flexible material layer and the rigid material layer within the flap portion and the hinge.

DETAILED DESCRIPTION

Figure 1:
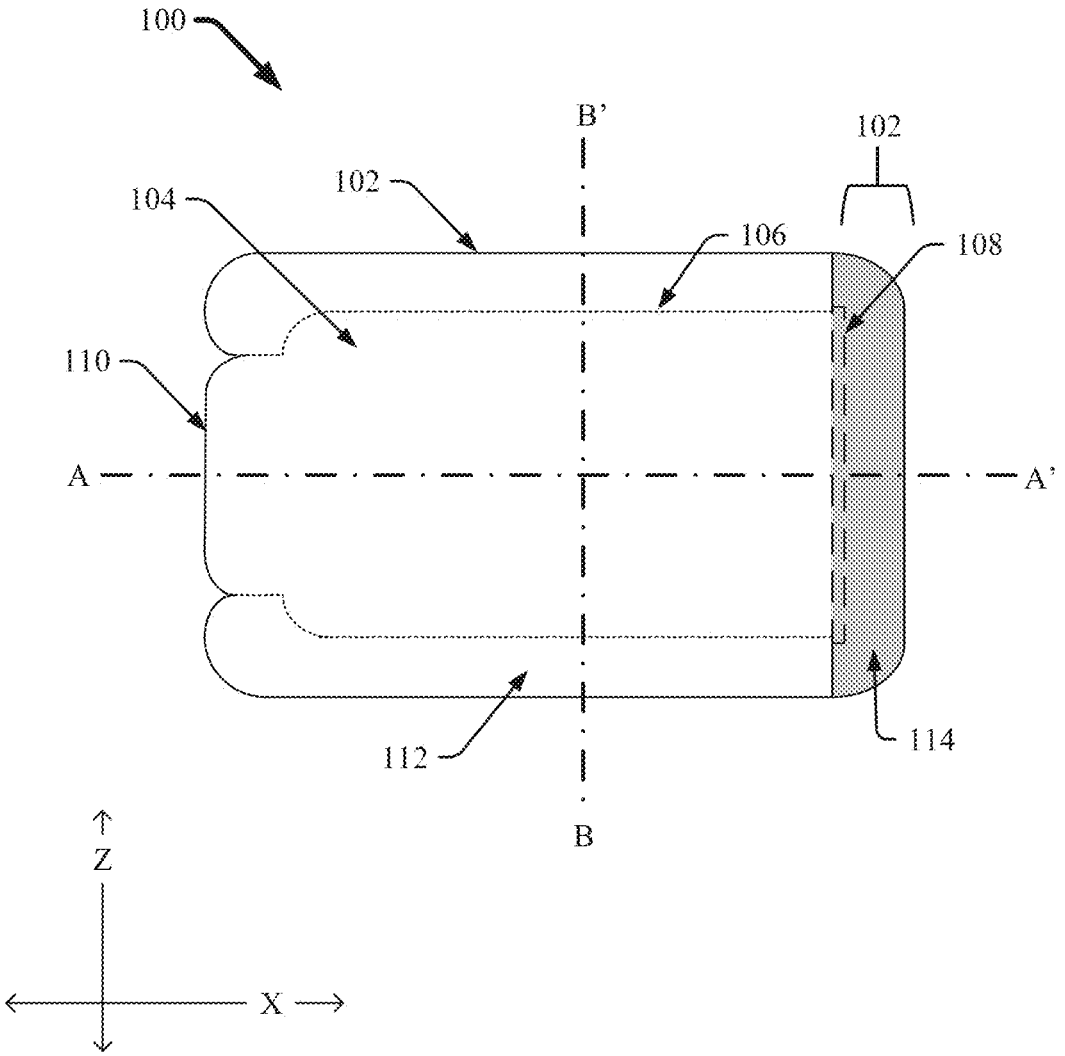
FIG. 1 illustrates a diagram of an example, non-limiting top-down view of a reclosure label that can be fixed to a product package in accordance with one or more embodiments described herein.

The following detailed description is merely illustrative and is not intended to limit embodiments and/or application or uses of embodiments. Furthermore, there is no intention to be bound by any expressed or implied information presented in the preceding Background or Summary sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details. Additionally, features depicted in the drawings with like shading, cross-hatching, and/or coloring can comprise shared compositions and/or materials.

Resealable label coverings have been employed on various types of product packages to modulate access to one or more openings in the package. Typically, the product package can house one or more articles that can deteriorate in prolonged exposure to the ambient environment. For example, the product package may house wetted articles. Once an opening in the package is exposed to remove one or more of the wetted articles, the remaining articles can become overly dry unless the opening is resealed. Thus, a reclosure label is conventionally fixed to the product package such that the reclosure label can be repeatedly pulled away from the package to expose the opening or pushed toward the package to seal the opening.

However, conventional reclosure labels are made of a strip of flexible or semi-flexible thermoplastic material that can easily become deformed during the repeated opening and closing operations. As a result of the deformation, the seal established by the reclosure label to enclose the product package opening can be comprised. For example, wrinkles in the reclosure label (e.g., created during operation of the label covering) can result in gaps between the reclosure label and the product package that can compromise the integrity of a seal meant to be established by the reclosure label over the product package opening. Label coverings that incorporate a rigid material have been explored; however, the rigid material impedes a hinge structure of the label. Thus, maintaining the reclosure label in an open state can be difficult, and/or the hinge section of the reclosure label can be prone to break and detach from the product package.

Various embodiments described herein include apparatuses, systems, and/or devices regarding a reclosure label comprising a rigid material and integral hinge. For example, the reclosure label can comprise multiple layers, including but not limited to: one or more rigid material layers, one or more flexible material layers, one or more adhesive layers, and/or one or more release coating layers. One or more of the layers can bend during operation of the reclosure label to serve as an integral hinge, whereby a portion of the reclosure label can remain fixed to a product package while the remainder of the reclosure label can be repeatedly separated and reattached to the product package.

FIG. 1 illustrates a diagram of an example, non-limiting top-down view of a reclosure label 100 in accordance with one or more embodiments described herein. Repetitive description of like elements employed in other embodiments described herein is omitted for sake of brevity. FIG. 1 depicts the reclosure label 100 having a rectangular shape; however, the architecture of the reclosure label 100 is not so limited. For example, shapes for the reclosure label 100 that include polygonal or circular shape are also envisaged.

FIG. 1 shows the reclosure label 100 in a closed orientation. As shown in FIG. 1, the reclosure label 100 can have multiple layers integrated within various portions and/or sections of the reclosure label 100. For example, the reclosure label 100 can include a label base 102 that can comprise one or more portions of the multiple layers that remain fixed to a surface (e.g., to a package surface) during operation of the reclosure label 100. Further, the reclosure label 100 can include a flap portion 104 defined by one or more cut lines 106 (e.g., delineated by dotted lines in FIG. 1). The flap portion 104 can comprise one or more portions of the multiple layers that can move away from, or toward, the surface (e.g., the package surface).

In various embodiments, the one or more cut lines 106 can indicate a solid cut in the reclosure label 100 or a perforated cut in the reclosure label 100. The flap portion 104 can extend from a hinge portion 108 (e.g., delineated by dashed lines in FIG. 1) to a distal end 110, which can serve as tab to ease manipulation of the flap portion 104. During operation of the reclosure label 100, the flap portion 104 can be moved away from the label base 102 to establish an open orientation. For example, the distal end 110 of the flap portion 104 can be pulled away from the label base 102. As the distal end 110 is moved away from the label base 102, the flap portion 104 can move away from the label base 102 along the cut lines 106. Further, the flap portion 104 can bend at the hinge portion 108. To re-establish the closed orientation, the flap portion 104 can be moved toward to the label base 102 and thereby unbend at the hinge portion 108.

During operation of the reclosure label 100, the hinge portion 108 can keep the flap portion 104 connected to the label base 102. For example, one or more layers of the reclosure label 100 can extend between the label base 102 and the flap portion 104 and serve as the hinge portion 108. For instance, one or more layers of the reclosure label 100 can be integral with the label base 102 and the flap portion 104 and can bend during operation of the reclosure label 100 to facilitate movement of the flap portion 104 while maintaining a connection between the flap portion 104 and the label base 102. Thus, the flap portion 104 can be pivotally secured to the label base 102.

In the exemplary embodiment shown in FIG. 1, one or more rigid material layers 112 can be positioned as the top-most layer of the reclosure label 100. Further, one or more flexible material layers 114 can be positioned below the one or more rigid material layers 112. In various embodiments, the one or more rigid material layers 112 can be composed of materials with sufficient stiffness to resist deformation during operation of the reclosure label 100. For instance, the one or more rigid material layers 112 can exhibit a rigidity ranging from, for example, greater than or equal to 30 millinewton meter (mN·m) and less than or equal to 250 (mN·m). Example materials that can comprise the one or more rigid material layers 112 can include, but are not limited to: polystyrene, polyester, polypropylene, a combination thereof, and/or the like. The one or more flexible material layers 114 can be more flexible (e.g., less stiff) than the one or more rigid material layers 112 so as to serve as the hinge portion 108 of the reclosure label 100. For instance, the one or more flexible material layers 114 can exhibit a rigidity ranging from, for example, greater than or equal to 3 (mN·m) and less than or equal to 30 (mN·m). Example materials that can comprise the one or more flexible material layers 114 can include, but are not limited to: polyethylene, polyester, polypropylene, a combination thereof, and/or the like.

In various embodiments, the one or more rigid material layers 112 can extend to the hinge portion 108; whereas the one or more flexible material layers 114 can extend across an entire, or substantially entire, length (e.g., along the "X" axis shown in FIG. 1) of the reclosure label 100. For example, the one or more flexible material layers 114 can extend through the hinge portion 108 to a far end of the reclosure label 100.

Figure 2:
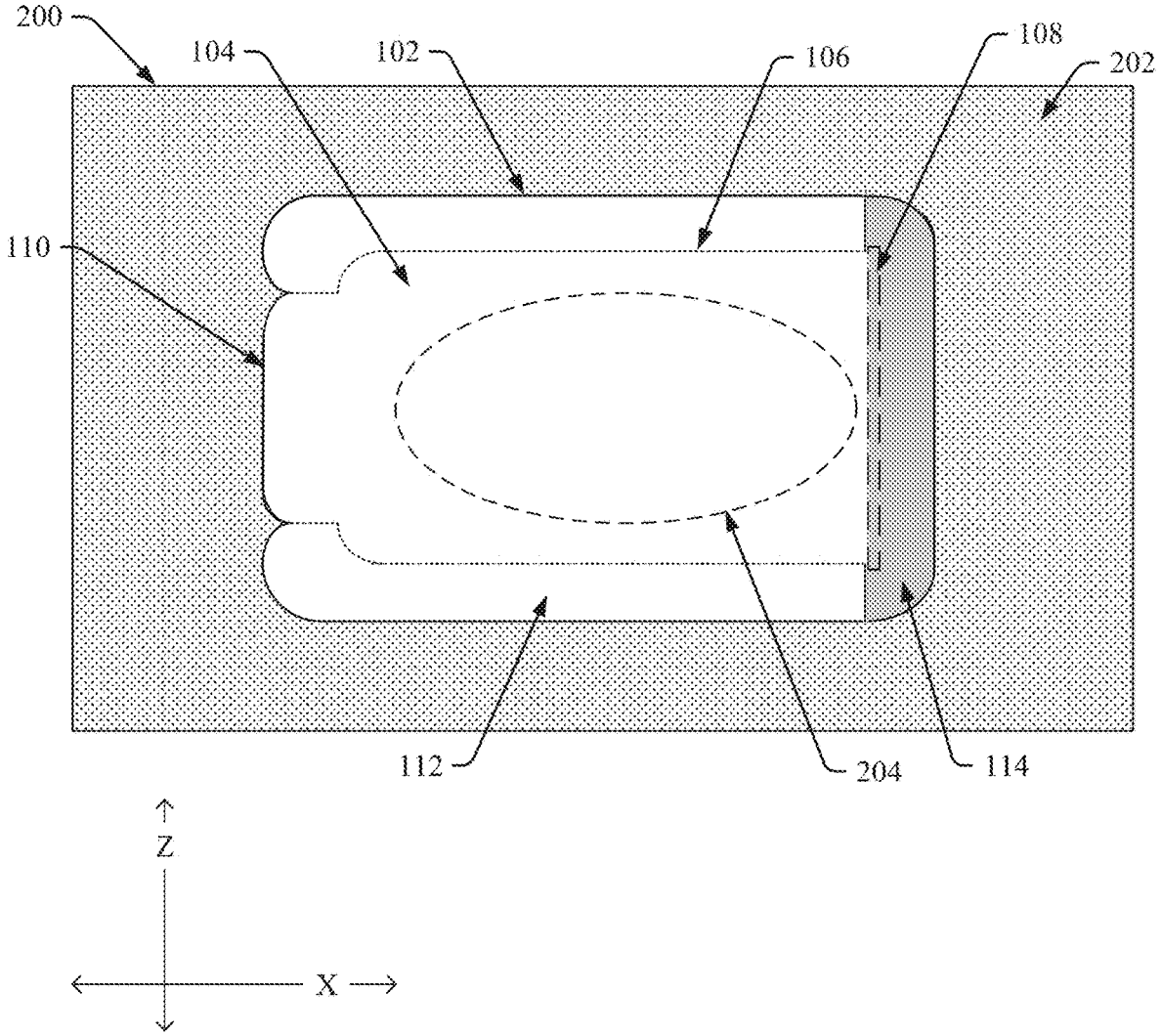
FIG. 2 illustrates a diagram of an example, non-limiting top-down view of a reclosure label that covers an opening in a product package, where the reclosure label can be pulled away from, and resealable to, the product package to modulate access to the opening in accordance with one or more embodiments described herein.

FIG. 2 illustrates a diagram of the example, non-limiting reclosure label 100 fixed to a product package 200 in accordance with one or more embodiments described herein. Repetitive description of like elements employed in other embodiments described herein is omitted for sake of brevity. FIG. 2 shows a top-down view of the reclosure label 100 on an exemplary product package 200.

As shown in FIG. 2, the exemplary product package 200 can comprise a package body 202 that can house one or more articles. In various embodiments, the package body 202 can be comprised of a flexible, thermoplastic material. Example materials that can comprise the package body 202 include, but are not limited to: polyethylene ("PE"), polyethylene terephthalate ("PET"), PET/PE, multilayer foil barrier, multilayer non-foil barrier, a combination thereof, and/or the like. The ends of the package body 202 can be sealed to protect the one or more housed articles from an ambient environment outside the package body 202. Thereby, the package body 202 can protect the one or more housed articles from the outside environment, which can deteriorate an effective use of the one or more articles.

Further, the product package 200 can include one or more openings 204 in the package body 202 to provide access to the one or more housed articles. For example, the one or more openings 204 can enable access to an internal space of the product package 200 that is defined by the package body 202. In various embodiments, the one or more articles housed within the product package 200 can be retrieved via the one or more openings 204.

Also shown in FIG. 2, the reclosure label 100 can be applied to a top surface of the package body 202 to cover the one or more openings 204 (e.g., can be applied to the surface of the package body 202 that defines the openings 204). For example, in FIG. 2 the one or more openings 204 are positioned under the reclosure label 100 (e.g., shown in a closed orientation), where the location of the one or more openings 204 is delineated by dashed lines. FIG. 2 depicts the reclosure label 100 having an elliptical shape; however, the architecture of the one or more openings 204 is not so limited. For example, shapes for the one or more openings 204 that include polygonal or circular shape are also envisaged.

The label base 102 can be fixed (e.g., via one or more adhesives) to the package body 202 adjacent to the one or more openings 204 such that the flap portion 104 can cover the one or more openings 204 while the reclosure label 100 is in the closed orientation. For example, the label base 102 can be fixed substantially surrounding, or partially surrounding, the one or more openings 204 (e.g., as show in FIG. 2). In various embodiments, fixation of the label base 102 to the surface of the package body 202 can establish a seal around the one or more openings 204. For example, a seal established by the label base 102 fixed to the package body 202 can be watertight and/or airtight. Additionally, the flap portion 104 can be temporarily adhered to the package body 202 to establish a resealable seal around the one or more openings 204, which can be broken and/or re-established based on the orientation and/or operation of the flap portion 104.

For example, while the reclosure label 100 is in the closed orientation (e.g., as shown in FIG. 2), the flap portion 104 can cover the one or more openings 204 and inhibit access to the inside of the package body 202. In various embodiments, the flap portion 104 can include a releasable adhesive that can form a seal with the surface of the package body 202 when the flap portion 104 contacts the package body 202 in the closed orientation. While the reclosure label 100 is in the open orientation, the flap portion 104 can be moved away from the label base 102 (e.g., and/or the package body 202) to expose the one or more openings 204, and thereby expose an internal space of the package body 202 (e.g., where one or more articles are housed). In various embodiments, the one or more flexible material layers 114 can bend at the hinge portion 108 to facilitate moving the flap portion 104 to the open orientation while keeping the flap portion 104 attached to the label base 102 and thereby the package body 202.

In various embodiments, the one or more rigid material layers 112 of the label base 102 can contribute to the rigidity of the package body 202 and/or the integrity of the one or more openings 204. For example, operating the flap portion 104 between open and closed orientations can impart a force on the package body 202 (e.g., near the one or more openings 204). The one or more rigid material layers 112 can stiffen the area of the package body 202 fixed to the reclosure label 100, and thereby reinforce the structural integrity of the package body 202 to meet the applied force.

Figure 3A:
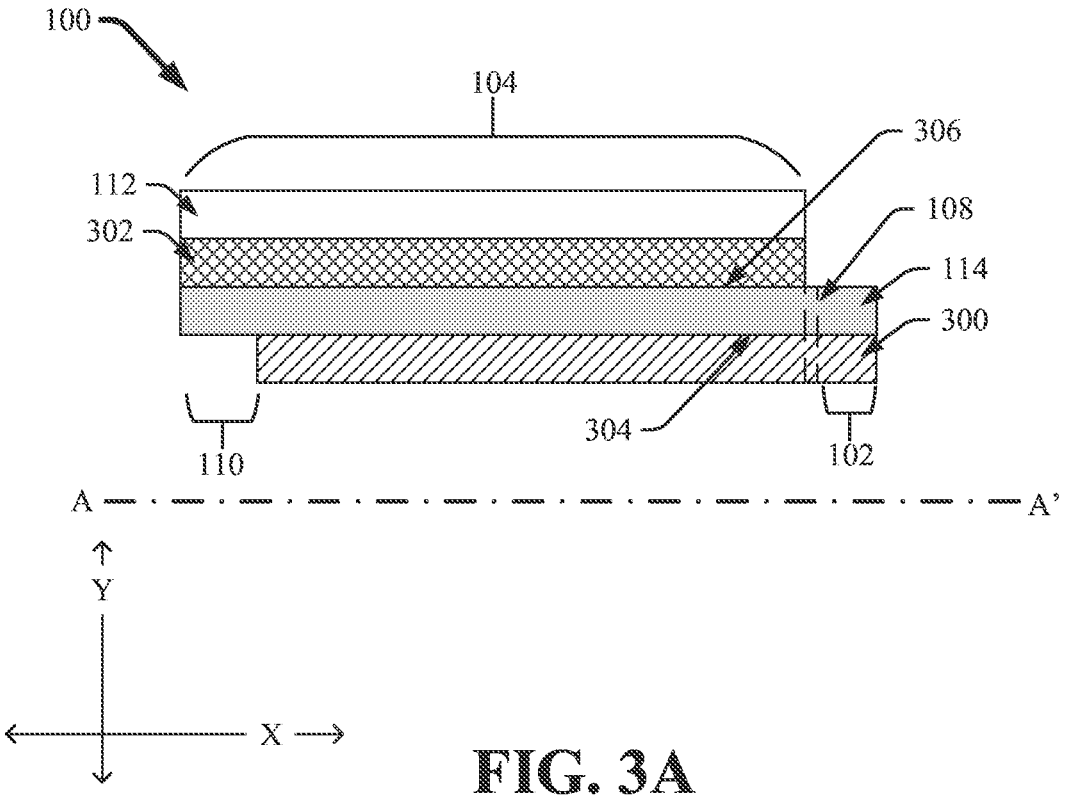
FIGS. 3A-3B illustrate diagrams of example, non-limiting cross-sectional views of a reclosure label that can be fixed to a product package in accordance with one or more embodiments described herein.
Figure 3B:
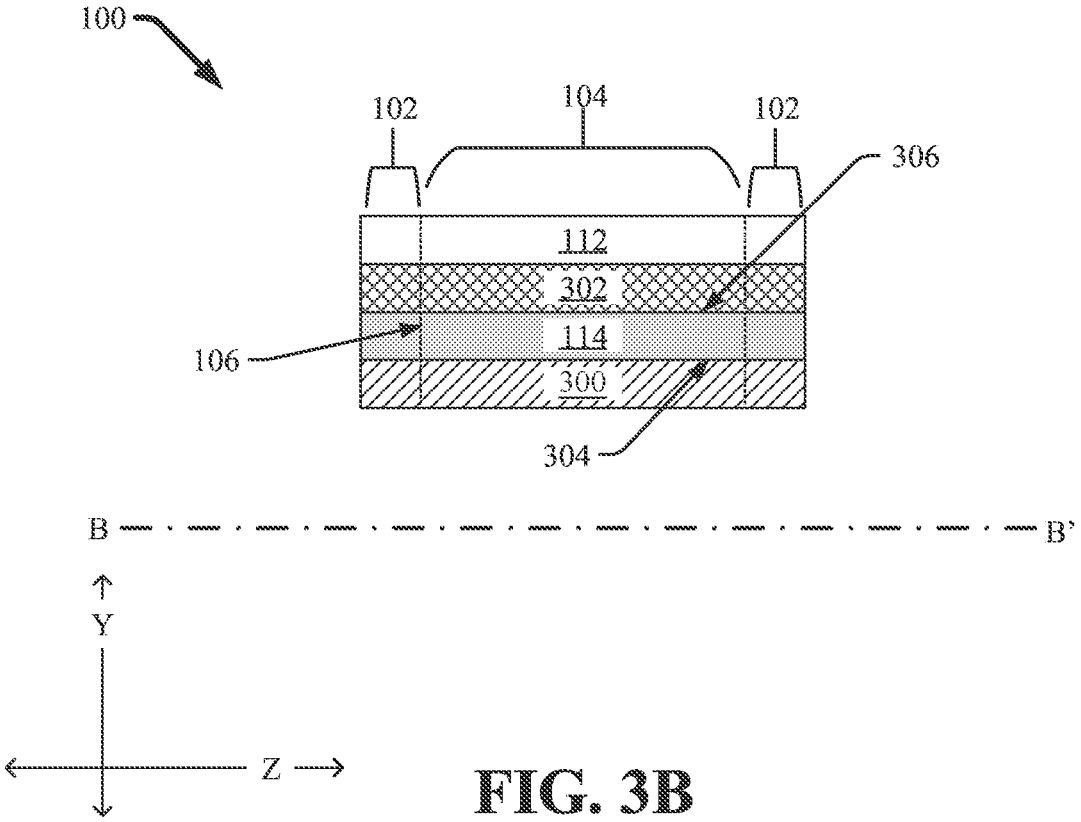

FIGS. 3A and/or 3B illustrate diagram of example, non-limiting cross-sectional views of the reclosure label 100 in accordance with one or more embodiments described herein. Repetitive description of like elements employed in other embodiments described herein is omitted for sake of brevity. FIG. 3A illustrates a cross-sectional view of the reclosure label 100 exemplified in FIG. 1 along the A-A' plane shown in FIG. 1. FIG. 3B illustrates a cross-sectional view of the reclosure label 100 exemplified in FIG. 1 along the B-B' plane shown in FIG. 1.

As shown in FIGS. 3A and/or 3B, the reclosure label 100 can further comprise one or more first adhesive layers 300 and/or one or more second adhesive layers 302. In one or more embodiments, the first adhesive layer 300 can be positioned on a first surface 304 of the one or more flexible material layers 114. Additionally, the second adhesive layer 302 can be positioned on a second surface 306 (e.g., opposite the first surface 304) of the one or more flexible material layers 114. In various embodiments, the one or more first adhesive layers 300 can be positioned on the entirety, or substantially the entirety, of the first surface 304. Alternatively, the one or more first adhesive layers 300 can be positioned on portions of the first surface 304 targeted for adhesion with another surface (e.g., portions of the first surface 304 targeted for adhesion with the package body 202. Additionally, in one or more embodiments the one or more second adhesive layers 302 can be positioned on portions of the second surface 306 that face the one or more rigid material layers 112. For example, FIG. 3A exemplifies that the one or more rigid material layers 112 may not cover one or more portions of the second surface 306, which can be free from the presence of the one or more second adhesive layers 302.

For example, the first surface 304 of the one or more flexible material layers 114 can face a surface of the package body 202, where the one or more first adhesive layers 300 can fix the one or more flexible material layers 114 to a package body 202. For instance, the reclosure label 100 can be fixed to product package 200 (e.g., as shown in FIG. 2) via the one or more first adhesive layers 300. Further, the second surface 306 of the one or more flexible material layers 114 can face the one or more rigid material layers 112, where the one or more second adhesive layers 302 can fix the one or more flexible material layers 114 to the one or more rigid material layers 112.

In various embodiments, the one or more first adhesive layers 300 can be a releasable adhesive. For instance, the one or more first adhesive layers 300 can be layers of removable pressure-sensitive adhesives that can adhere to a surface (e.g., package body 202) to facilitate a fixation of the label base 102 and/or a closed orientation of the flap portion 104, and can release from the surface to facilitate an open orientation of the reclosure label 100. In various embodiments, the one or more first adhesive layers 300 can retain their adhesive qualities as the flap portion 104 is peeled away from the surface of the package body 202. Example materials that can be comprised within the one or more first adhesive layers 300 can include, but are not limited to: a solvent-based adhesive, an emulsion adhesive, a hot melt adhesive, a combination thereof, and/or the like. In various embodiments, the one or more second adhesive layers 302 can be a permanent, or substantially permanent, adhesive. For instance, the one or more second adhesive layers 302 can be layers of adhesive that can establish an adhesion that is difficult to undue. Example materials that can be comprised within the one or more second adhesive layers 302 can include, but are not limited to: an ultraviolet curable adhesive, a solvent-based adhesive, an emulsion adhesive, a combination thereof, and/or the like.

Plane A-A' depicts a cross-section of the label base 102 and flap portion 104 along the "X" axis shown in FIG. 1, where the reclosure label 100 is in a closed orientation. As shown in FIG. 3A, the one or more flexible material layers 114 can be positioned under (e.g., along the "Y" axis shown in FIG. 3A) the one or more rigid material layers 112, and/or can be directly adhered to the package body 202 via first adhesive layer 300. For instance, the one or more flexible material layers 114 can be a base layer of the reclosure label 100. Further, the one or more flexible material layers 114 can extend beyond the flap portion 104, through the hinge portion 108, and into the label base 102. For instance, a portion of the one or more flexible material layers 114 located within the hinge portion 108 can be an integral hinge of the reclosure label 100. In various embodiments, extension of the one or more rigid material layers 112 can stop at the hinge portion 108 so as to not impede a bending of the one or more flexible material layers 114 during operation of the reclosure label 100. Additionally, in one or more embodiments the distal end 110 of the flap portion 104 can be free of the first adhesive layer 300. Thereby, the distal end 110 of the flap portion 104 can remain unfixed from the package body 202 and can serve as a tab that can be grasped to facilitate operation of the reclosure label 100.

Plane B-B' depicts a cross-section of the label base 102 and flap portion 104 along the "Z" axis shown in FIG. 1, where the reclosure label 100 is in a closed orientation. As shown in FIG. 3B, the one or more rigid material layers 112, second adhesive layers 302, flexible material layers 114, and/or first adhesive layers 300 can extend across the entirety, or substantially the entirety, of the width (e.g., along the "Z" axis shown in FIG. 3B) of the reclosure label 100. Further, the one or more cut lines 106 that define the flap portion 104 can extend through the entire, or substantially the entire, thickness (e.g., along the "Y" axis shown in FIG. 3B) of the reclosure label 100. Thereby, the one or more cut lines 106 can enable the flap portion 104 to move away from the label base 102 when operating the reclosure label 100 in an open orientation. In various embodiments, a thickness of the layers of the reclosure label 100 can depend on a desired function and/or material composition of the reclosure label 100.

Figure 4:
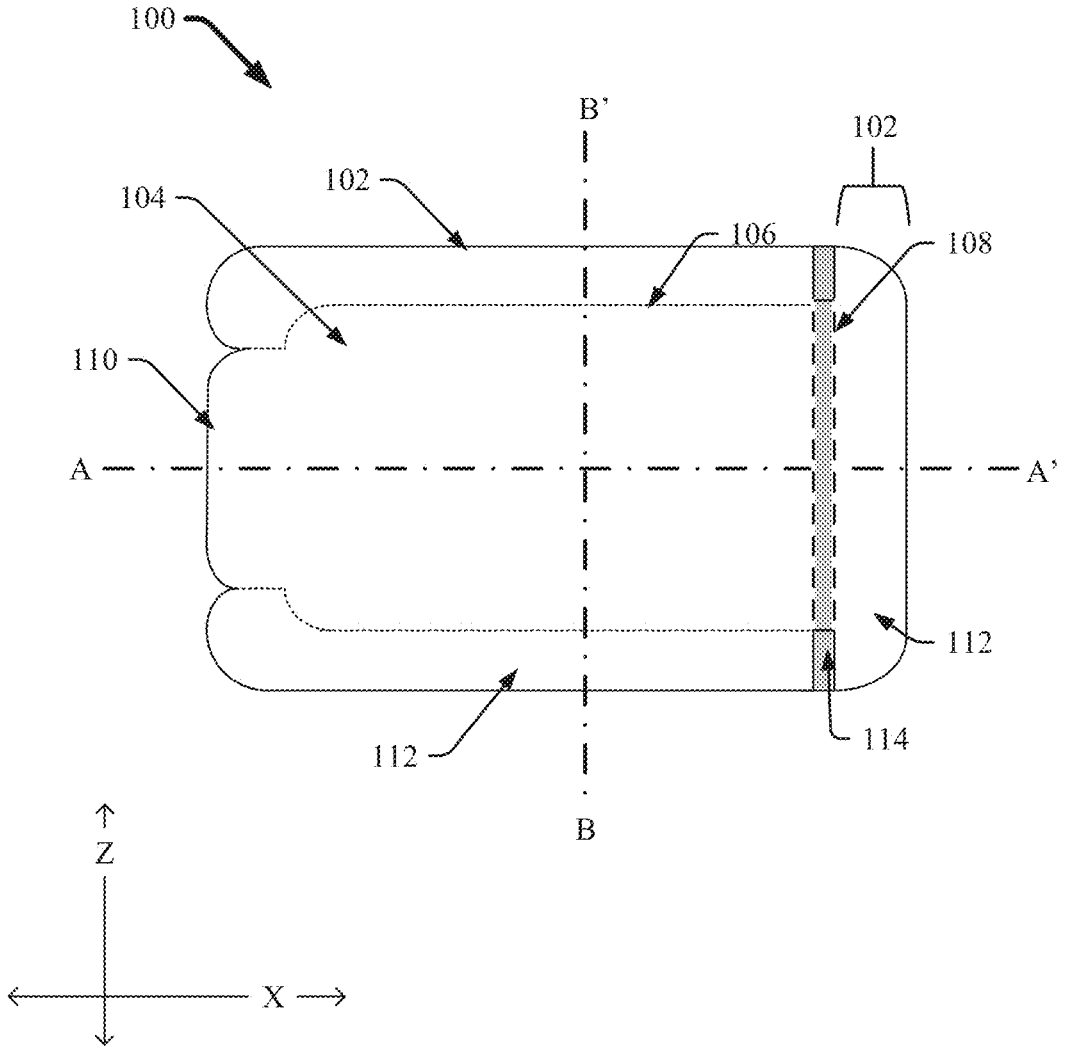
FIG. 4 illustrates a diagram of an example, non-limiting top-down view of a multi-layered reclosure label that can comprise one or more flexible layers and rigid layers in accordance with one or more embodiments described herein.

FIG. 4 illustrates another diagram of the example, non-limiting reclosure label 100 in accordance with one or more embodiments described herein. Repetitive description of like elements employed in other embodiments described herein is omitted for sake of brevity. FIG. 4 illustrates a top-down view of an exemplary embodiment of the reclosure label 100 in which the one or more rigid material layers 112 can be positioned on opposing sides of the hinge portion 108.

As shown in FIG. 4, the one or more rigid material layers 112 can be positioned on both sides of the hinge portion 108 without being located within the hinge portion 108. For example, one or more portions of the one or more rigid material layers 112 can be comprised within the flap portion 104 at a first side of the hinge portion 108, and one or more other portions of the one or more rigid material layers 112 can be comprised within the label base 102 at a second, opposing side of the hinge portion 108.

In various embodiments, the one or more rigid material layers 112 can enhance the rigidity of the one or more flexible material layers 114 where the rigid material layers 112 and flexible material layers 114 are adhered to each other via the one or more second adhesive layers 302. As shown in FIG. 4, in one or more embodiments the hinge portion 108 can remain free from the presence of the one or more rigid material layers 112. Thereby, the one or more flexible material layers 114 can maintain their flexibility within the hinge portion 108, and can thereby be bent when transitioning the reclosure label 100 between open and closed orientations.

Figure 5:
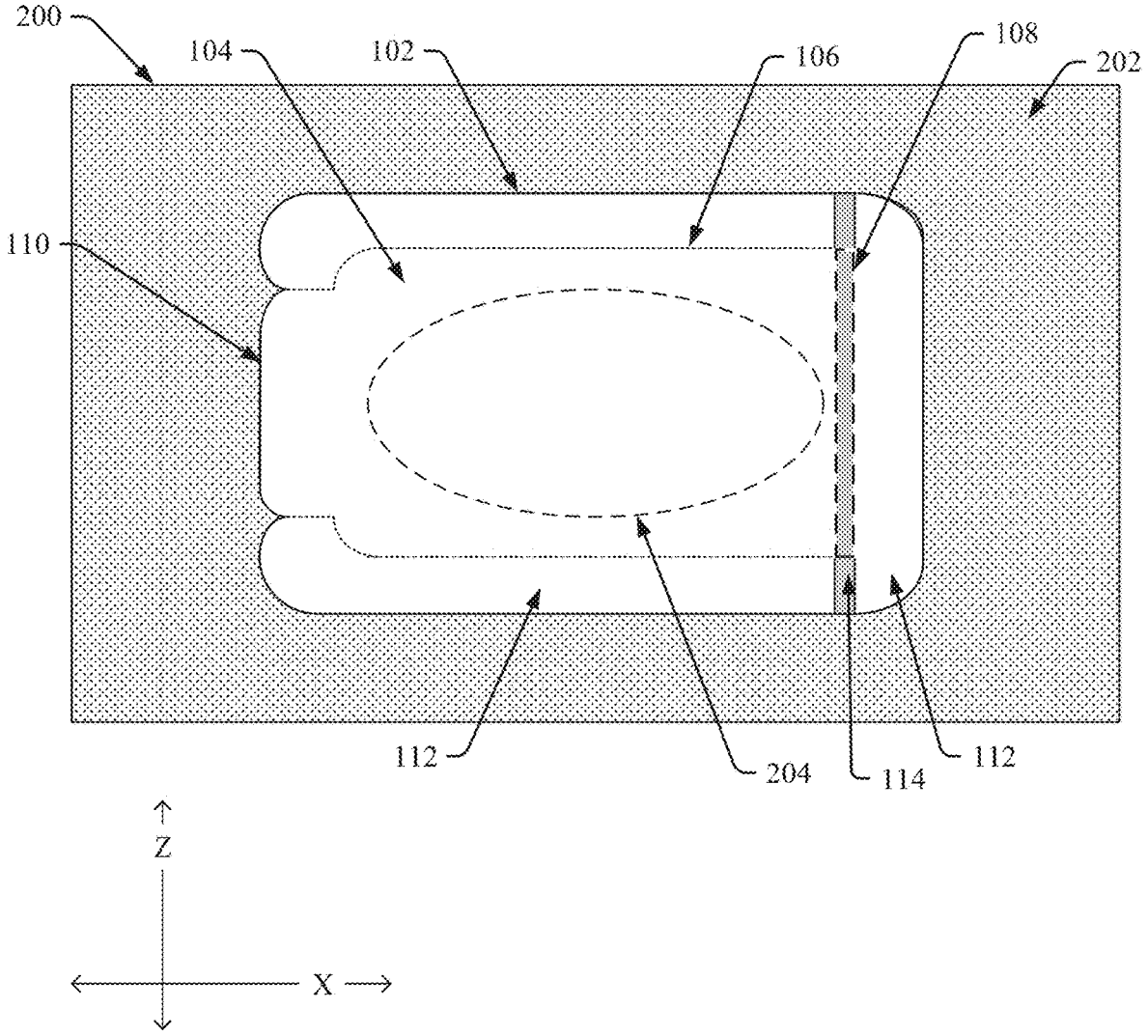
FIG. 5 illustrates a diagram of an example, non-limiting top-down view of a resealable multi-layered reclosure label fixed to a product package in accordance with one or more embodiments described herein.

FIG. 5 illustrates a diagram of the example, non-limiting reclosure label 100 of FIG. 4 fixed to a product package 200 in accordance with one or more embodiments described herein. Repetitive description of like elements employed in other embodiments described herein is omitted for sake of brevity. As shown in FIG. 5, by positioning the one or more rigid material layers 112 on both sides of the hinge portion 108 (e.g., along the "X" axis shown in FIG. 5), the one or more rigid material layers 112 can provide additional rigidity to the package body 202 surrounding the one or more openings 204.

For example, further positioning the one or more rigid material layers 112 onto opposing sides of the hinge portion 108 can increase the amount of rigid material layers 112 comprised within the label base 102 (e.g., as compared to the exemplary embodiment shown in FIG. 2). Further, the increased amount of rigid material layers 112 comprising the label base 102 can increase the amount and/or area of stiffness contributed to the package body 202 by the reclosure label 100. Moreover, an increased stiffness of the area of the package body 202 adjacent to the one or more openings 204 can help maintain the shape of the one or more openings 204 during operation of the reclosure label 100. For example, a force used to move the flap portion 104 away from the label base 102 can, in some instances, be extended to the package body 202, causing stretching and/or otherwise distortion the shape of the one or more openings 204. The enhanced stiffness to the package body 202 provided by the one or more rigid material layers 112 can impede a distortion of the shape of the one or more openings 204.

Figure 6:
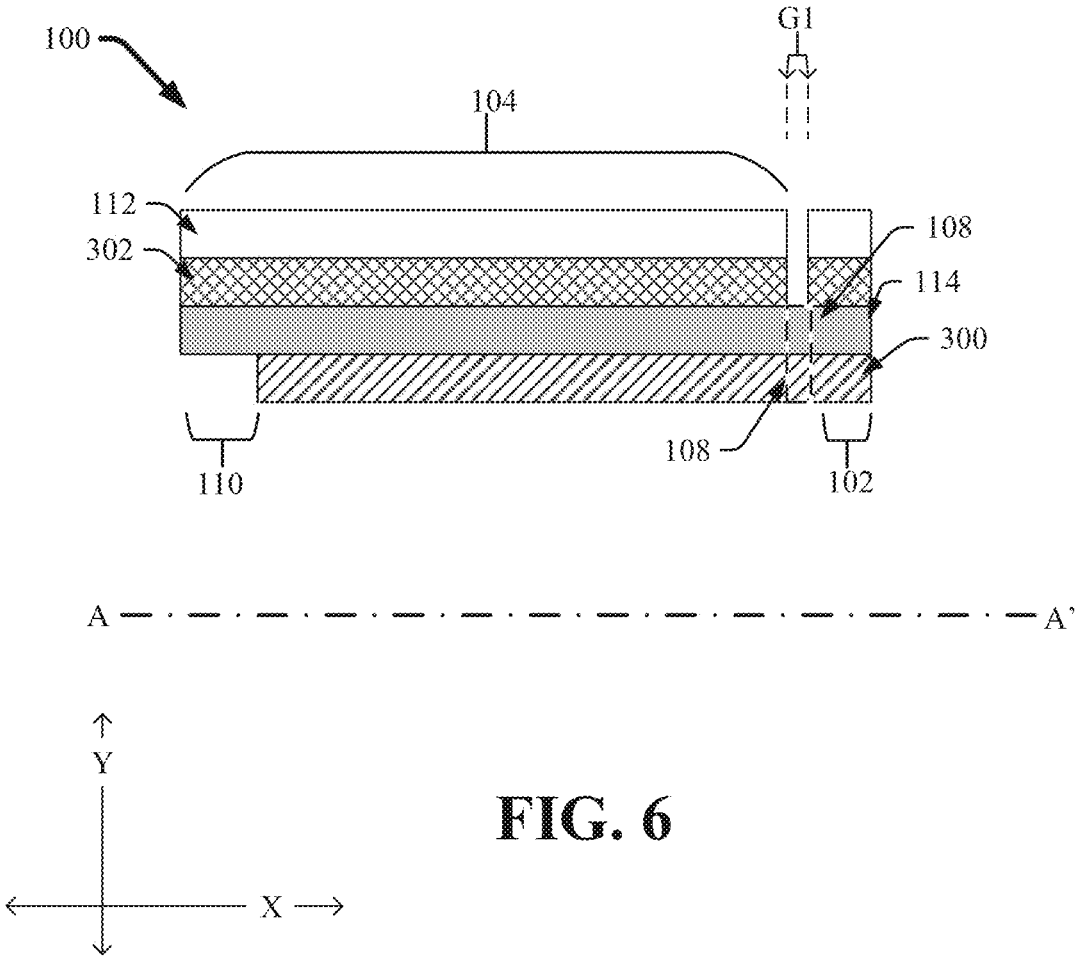
FIG. 6 illustrates a diagram of an example, non-limiting cross-sectional view of a multi-layered reclosure label that can be fixed to a product package in accordance with one or more embodiments described herein.

FIG. 6 illustrates a diagram of an example, non-limiting cross-sectional view of the reclosure label 100 in accordance with one or more embodiments described herein. Repetitive description of like elements employed in other embodiments described herein is omitted for sake of brevity. FIG. 6 illustrates a cross-sectional view of the reclosure label 100 exemplified in FIG. 4 along the A-A' plane shown in FIG. 4. FIG. 3B illustrates a cross-sectional view of the reclosure label 100 exemplified in FIG. 4 along the B-B' plane shown in FIG. 4.

As shown in FIG. 6, a gap (e.g., represented by "G1" in FIG. 6) in the one or more rigid material layers 112 and/or second adhesive layers 302 can be positioned over the hinge portion 108 and/or can separate an end of the flap portion 104 from a portion of the label base 102. A width (e.g., along the "X" axis shown in FIG. 6) of the gap (e.g., represented by "G1" in FIG. 6), and/or the hinge portion 108, can depend on a thickness (e.g., along the "Y" axis shown in FIG. 6) of the one or more rigid material layers 112. For example, as the flap portion 104 is moved away from the label base 102 to achieve an open orientation, an end of the one or more rigid material layers 112 comprised within the flap portion 104 can travel into the gap (e.g., represented by "G1" in FIG. 6) as the one or more flexible material layers 114 bend in the hinge portion 108. As the thickness (e.g., along the "Y" axis shown in FIG. 6) of the one or more rigid material layers 112 increases, the width (e.g., along the "X" axis shown in FIG. 6) of the gap (e.g., represented by "G1" in FIG. 6) can also increase to accommodate for travel of the flap portion 104 into the gap space.

Figure 7:
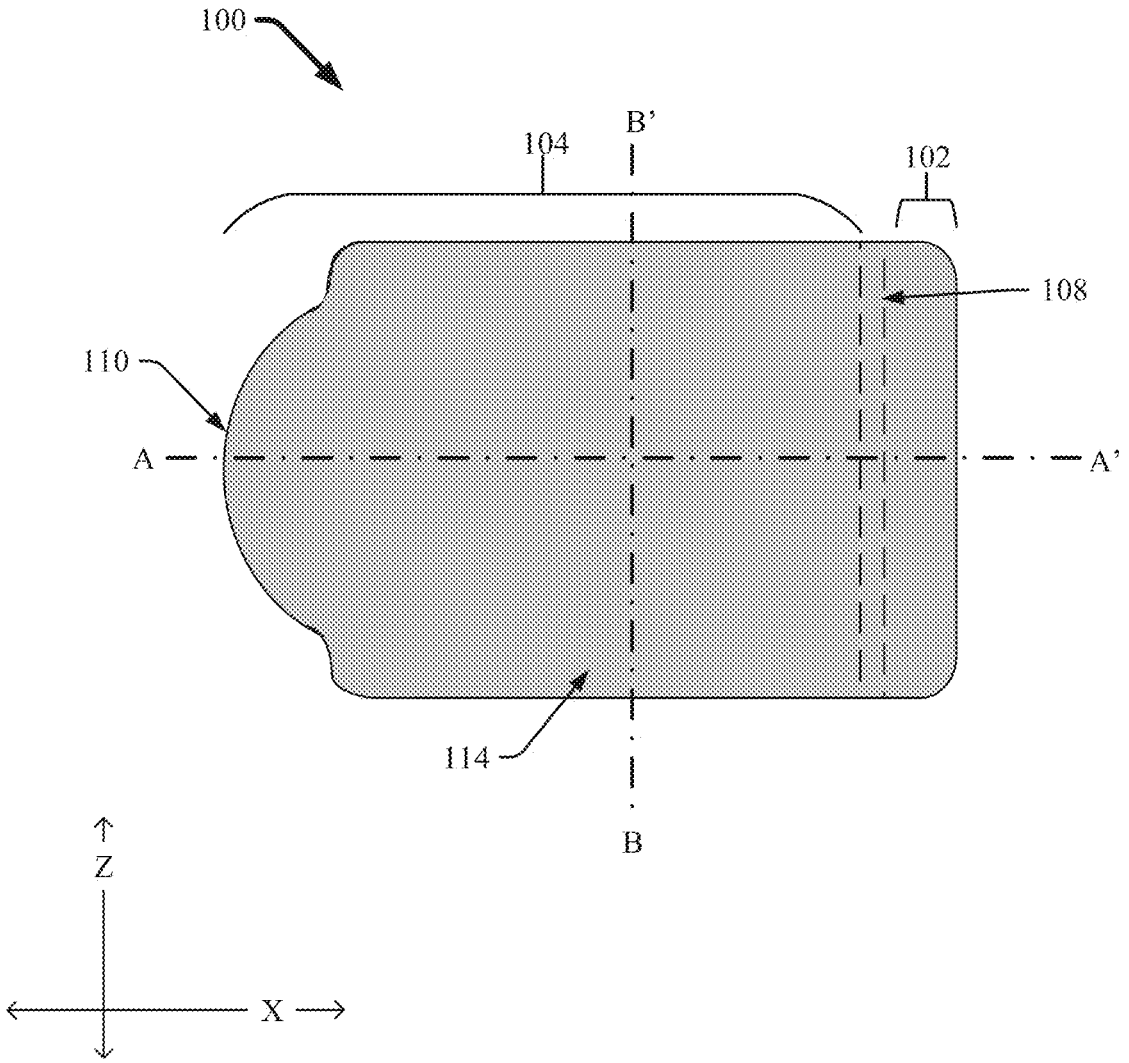
FIG. 7 illustrates a diagram of an example, non-limiting top-down view of a multi-layered reclosure label that can comprise one or more flexible layers and rigid layers in accordance with one or more embodiments described herein.

FIG. 7 illustrates another diagram of the example, non-limiting reclosure label 100 in accordance with one or more embodiments described herein. Repetitive description of like elements employed in other embodiments described herein is omitted for sake of brevity. FIG. 7 depicts another exemplary embodiment of the reclosure label 100, where the one or more flexible material layers 114 can be positioned over the one or more rigid material layers 112. For example, the one or more flexible material layers 114 can be the top-most layer of the reclosure label 100 and the one or more rigid material layers 112 can be a base layer of the reclosure label 100.

As shown in FIG. 7, the hinge portion 108, and thereby the flap portion 104, can extend across the entire, or substantially the entire, width (e.g., along the "Z" axis shown in FIG. 7) of the reclosure label 100. As described in various embodiments described herein, the one or more flexible material layers 114 can be comprised within the flap portion 104, can extend across the hinge portion 108, and can be comprised within the label base 102. For example, the flap portion 104 and at least a portion of the label base 102 can be positioned on opposing sides of the hinge portion 108 (e.g., as shown in FIG. 7). For instance, in FIG. 7 the portion of the one or more flexible material layers 114 located to the left of the hinge portion 108 can be comprised within the flap portion 104, while the portion of the one or more flexible material layers 114 located to the right of the hinge portion 108 can be comprised within the label base 102.

As the flap portion 104 is moved to an open orientation (e.g., via pulling the distal end 110 as a tab), a portion of the one or more flexible material layers 114 located within the hinge portion 108 can bend while a portion of the one or more flexible material layers 114 comprised within the label base 102 can remain fixed in place. For example, the portion of the one or more flexible material layers 114 comprised within the label base 102 can be adhered (e.g., via second adhesive layer 302) to the one or more underlying rigid material layers 112. The enhanced rigidity provided by the adhesion to the one or more rigid material layers 112 can inhibit a bending of the one or more flexible material layers 114 in the label base 102.

Figure 8:
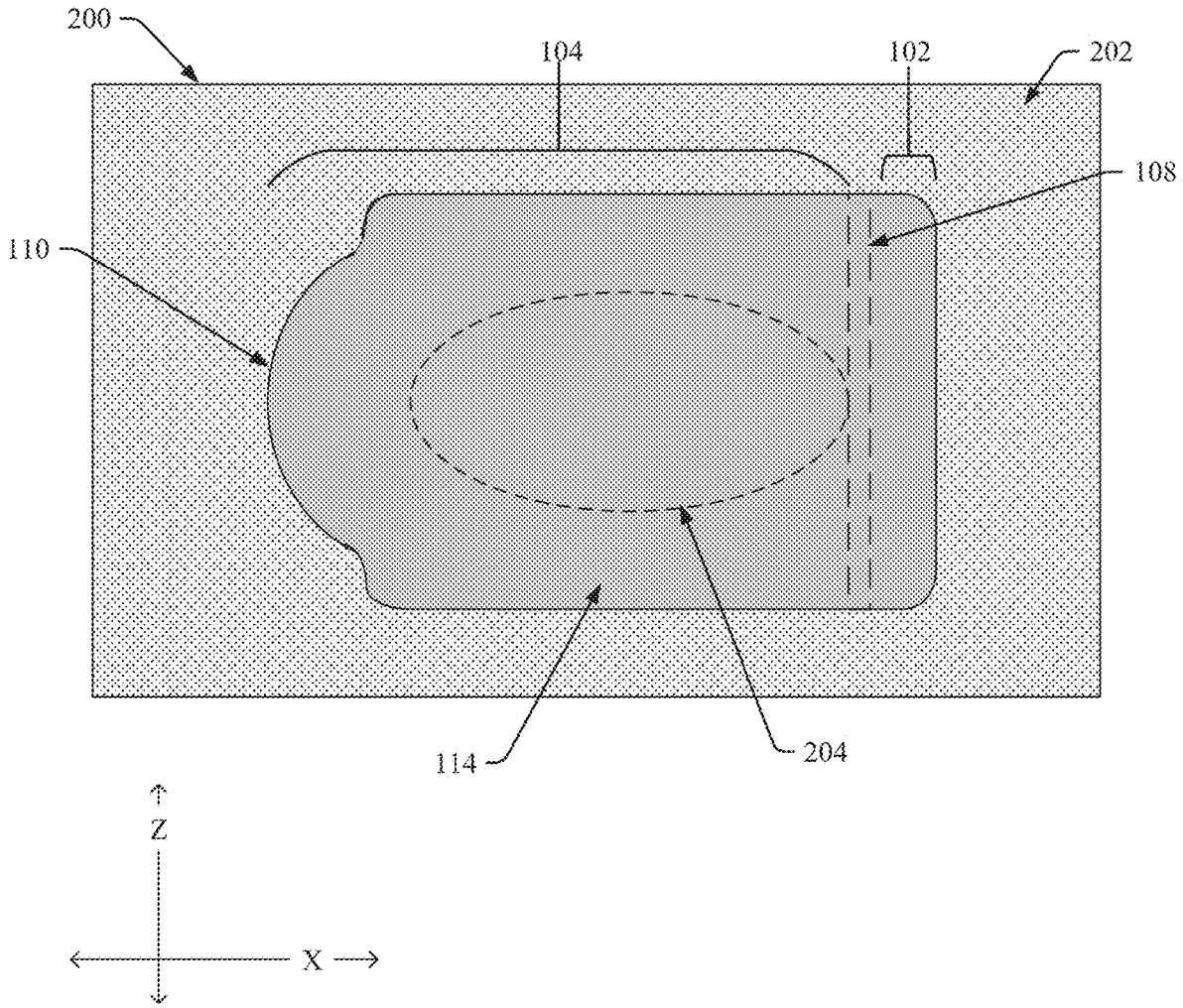
FIG. 8 illustrates a diagram of an example, non-limiting top-down view of a resealable multi-layered reclosure label fixed to a product package in accordance with one or more embodiments described herein.

FIG. 8 illustrates a diagram of the example, non-limiting reclosure label 100 fixed to a product package 200 in accordance with one or more embodiments described herein. Repetitive description of like elements employed in other embodiments described herein is omitted for sake of brevity. FIG. 8 shows a top-down view of the reclosure label 100 depicted in FIG. 7 fixed to an exemplary product package 200. As shown in FIG. 8, the reclosure label 100 can be positioned such that the flap portion 104 can cover the one or more openings 204 when the reclosure label 100 is in a closed orientation. For example, the hinge portion 108 can be positioned adjacent to the one or more openings 204 to enable the flap portion 104 to move away from the package body 202 and expose the one or more openings 204.

Figure 9A:
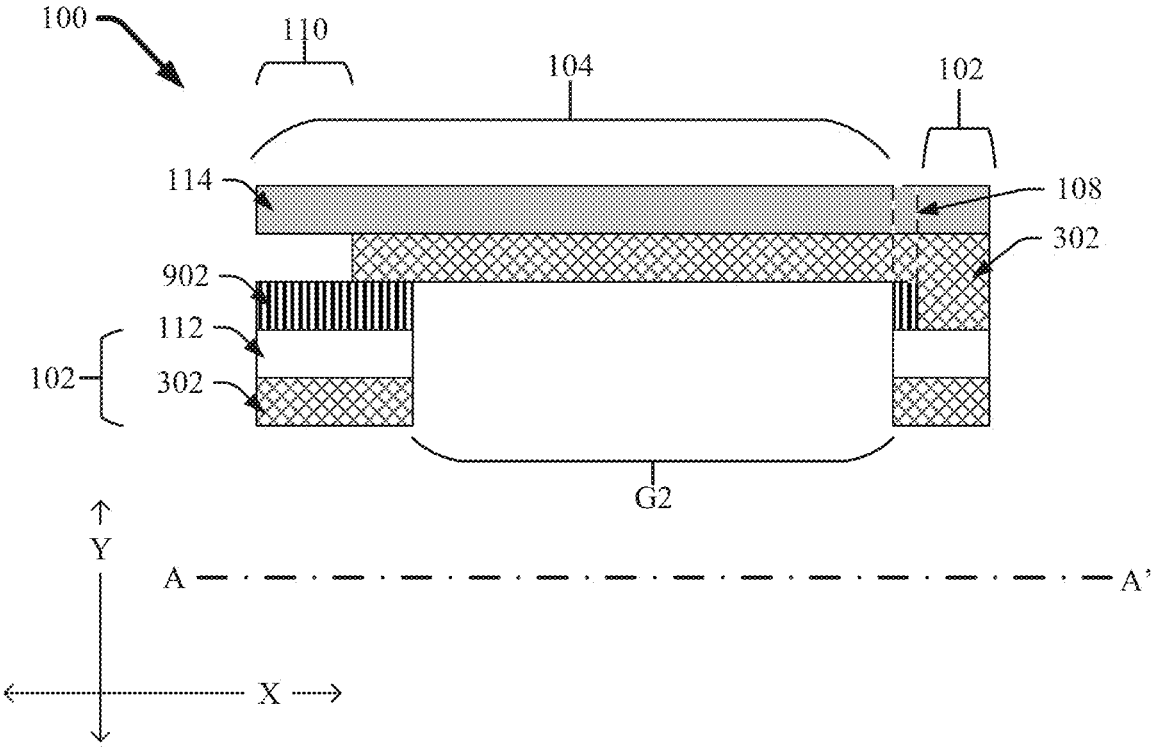
FIGS. 9A-9B illustrate diagrams of example, non-limiting cross-sectional views of a multi-layered reclosure label that can be fixed to a product package in accordance with one or more embodiments described herein.
Figure 9B:
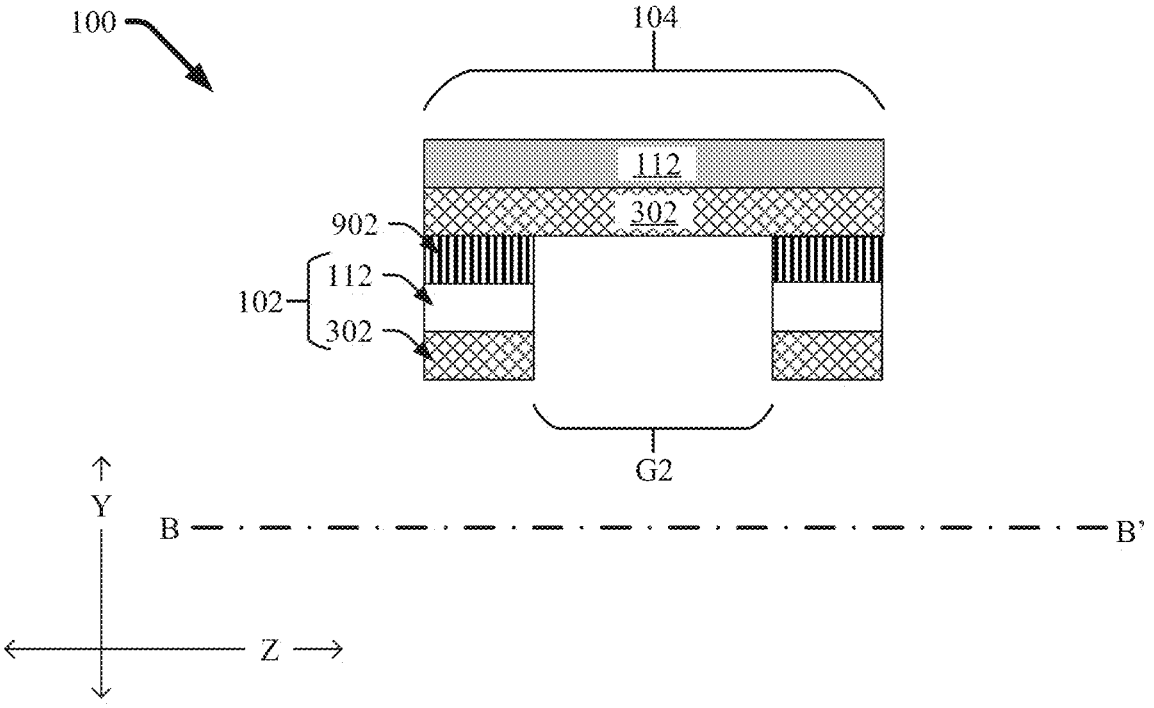

FIGS. 9A and/or 9B illustrate diagrams of example, non-limiting cross-sectional views of the reclosure label 100 in accordance with one or more embodiments described herein. Repetitive description of like elements employed in other embodiments described herein is omitted for sake of brevity. FIG. 9A illustrates a cross-sectional view of an embodiment of the reclosure label 100 exemplified in FIG. 7 along the A-A' plane shown in FIG. 7. FIG. 9B illustrates a cross-sectional view of an embodiment of the reclosure label 100 exemplified in FIG. 7 along the B-B' plane shown in FIG. 7.

As shown in FIGS. 9A and/or 9B, arrangement of the one or more rigid material layers 112 and/or flexible material layers 114 can vary. For example, in one or more embodiments, the one or more flexible material layers 114 can be positioned on top of the one or more rigid material layers 112 (e.g., along the "Y" axis shown in FIG. 9A). Throughout the various embodiments described herein, the second adhesive layer 302 (e.g., a permanent adhesive) can be positioned between the one or more rigid material layers 112 and/or flexible material layers 114 (e.g., thereby adhering at least a portion of the rigid material layers 112 and/or flexible material layers 114 together). Additionally, throughout the various embodiments described herein, the first adhesive layer 300 can be positioned under the bottom-most (e.g., along the "Y" axis shown in FIG. 9A) rigid material layer 112 or flexible material layer 114 (e.g., thereby positioned under the base layer of the reclosure label 100). For example, the first adhesive layer 300 can adhere the flexible material layer 114 to a package body 202 when the bottom-most layer of the reclosure label 100 is the flexible material layer 114 (e.g., as shown in FIG. 3A), or can adhere the rigid material layer 112 to a package body 202 when the bottom-most layer of the reclosure label 100 is the rigid material layer 112.

In various embodiments, the one or more second adhesive layers 302 (e.g., a permanent adhesive) can fix the bottom-most layer of the reclosure label 100 to the package body 202. For example, where the one or more rigid material layers 112 are the bottom-most layer of the reclosure label 100, the one or more second adhesive layers 302 can be positioned on the top and bottom surfaces of the rigid material layer 112 (e.g., as shown in FIG. 9A). Thereby, the one or more rigid material layers 112 (e.g., constituting the base layer of the reclosure label 100) can be permanently adhered to the package body 202.

Also shown in FIGS. 9A and/or 9B, the reclosure label 100 can further comprise one or more release layers 902. The one or more release layers 902 can be positioned on one or more portions of the rigid material layers 112 that underly the flap portion 104 and/or the hinge portion 108. Where the one or more release layers 902 are located, adhesion between the one or more rigid material layers 112 and the second adhesive layer 302 can be impeded. For example, the one or more release layers 902 can prevent adhesion between the one or more flexible material layers 114 and rigid material layers 112 under the flap portion 104 and/or the hinge portion 108. Example materials that can be comprised within the one or more release layers 902 can include, but are not limited to: silicone, an ultraviolet coating, a release coating, a combination thereof, and/or the like. For instance, the one or more release layers 902 can be one or more release coatings used to mitigate the adhesive properties of the one or more second adhesive layers 302.

At least because the one or more release layers 902 inhibit adhesion of the one or more flexible material layers 114 to portions of the rigid material layers 112 aligned under the flap portion 104, the flap portion 104 can be moved away from the label base 102. Likewise, at least because the one or more release layers 902 inhibit adhesion of the one or more flexible material layers 114 to portions of the rigid material layers 112 aligned under the hinge portion 108, the flexible material layers 114 traversing the hinge portion 108 can bend away from the label base 102 during operation of the reclosure label 100. For instance, under the flap portion 104 and/or the hinge portion 108, the label base 102 can be comprised of the one or more rigid material layers 112 and first adhesive layers 300.

In various embodiments, the label base 102 (e.g., comprising the rigid material layer 112 and/or first adhesive layer 300) can have a gap (e.g., represented by "G2") that can be aligned with the one or more openings 204 of a product package 200 when the reclosure label 100 is fixed to the package body 202. Thus, the one or more rigid material layers 112 can surround, or partially surround, the one or more openings 204, thereby providing enhanced rigidity to the package body 202 while not interfering with accessibility granted by the one or more openings 204. Further, the one or more flexible material layers 114, and/or second adhesive layers 302, can extend from the hinge portion 108, over the gap (e.g., represented by "G2") in the label base 102, to the distal end 110. Thus, in a closed orientation, a portion of the one or more flexible material layers 114 can: form the flap portion 104, release from a portion of the one or more rigid material layers 112 (e.g., due to the one or more release layers 902), and/or cover one or more openings 204 when the reclosure label 100 is fixed to a product package 200 in a closed orientation.

While a first portion of the label base 102 positioned under the flap portion 104 and/or the hinge portion 108 can comprise the one or more rigid material layers 112 and/or first adhesive layers 300; a second portion of the label base 102 positioned adjacent to the hinge portion 108 (e.g., at a side of the hinge portion 108 opposite the flap portion 104) can further include the one or more flexible material layers 114. For example, the one or more release layers 902 can be absent from one or more positions under the one or more second adhesive layers 302. At least due the absence of the one or more release layers 902, the one or more second adhesive layers 302 can extend to the one or more underlying rigid material layers 112; thereby adhering at least a portion of the one or more flexible material layers 114 to the one or more rigid material layers 112. The portion of the one or more flexible material layers 114 adhered to the one or more rigid material layers 112 can thereby remain fixed during operation of the reclosure label 100 and thus a part of the label base 102 (e.g., as shown in FIG. 9A).

As shown in FIG. 9B, the one or more release layers 902 can be positioned between the one or more flexible material layers 114 and rigid material layers 112 along the B-B' plane shown in FIG. 7. As described above, the one or more release layers 902 can impede an adhesion between the one or more flexible material layers 114 and the one or more rigid material layers 112; thereby enabling the flap portion 104 (e.g., comprising the one or more flexible material layers 114) to move unimpeded by the one or more rigid material layers 112. Further, in the closed orientation, the one or more rigid material layers 112 can structurally support the flap portion 104 (e.g., the flap portion 104 can rest on one or more portions of the label base 102, rather than resting on the surface of the package body 202).

Figure 10A:
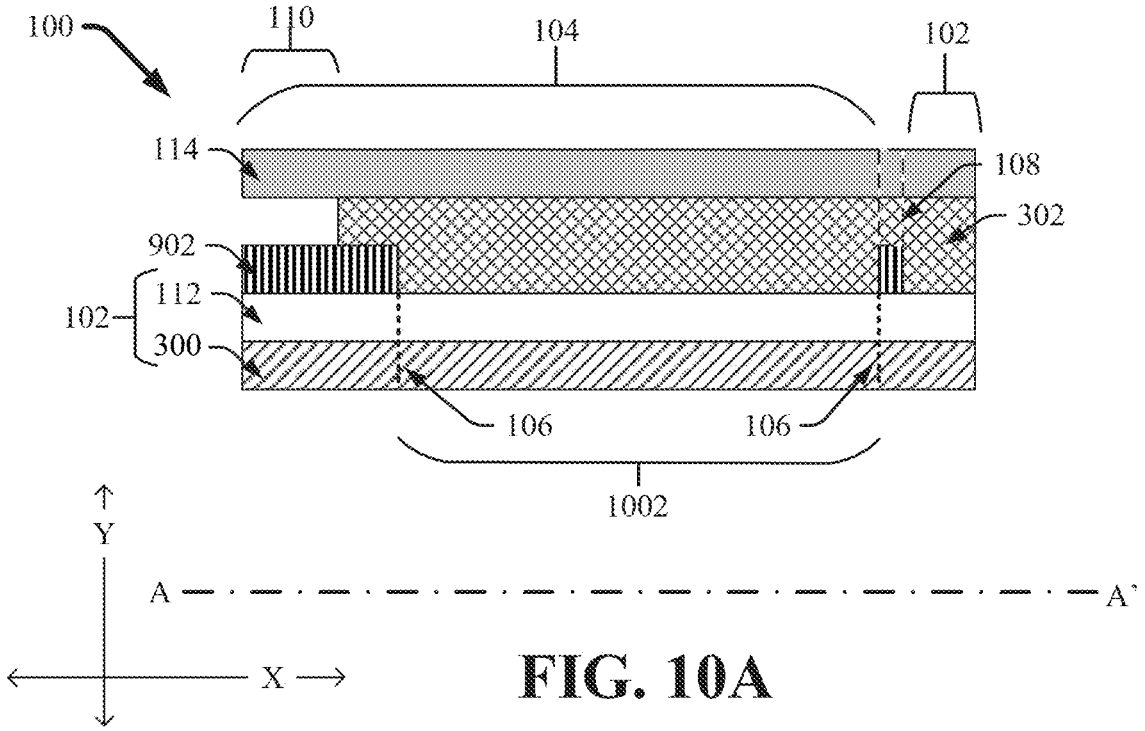
FIGS. 10A-10B illustrate diagrams of example, non-limiting cross-sectional views of a multi-layered reclosure label that can be fixed to a product package in accordance with one or more embodiments described herein.
Figure 10B:
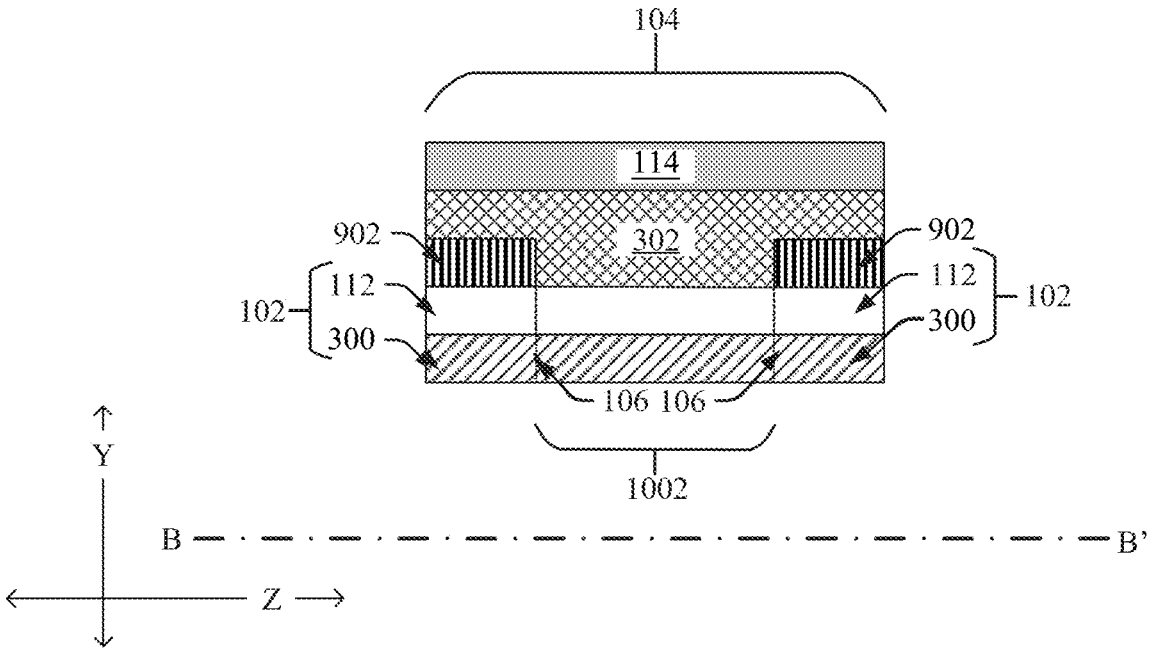

FIGS. 10A and 10B illustrate diagrams of example, non-limiting cross-sectional views of the reclosure label 100 in accordance with one or more embodiments described herein. Repetitive description of like elements employed in other embodiments described herein is omitted for sake of brevity. FIG. 10A illustrates a cross-sectional view of an embodiment of the reclosure label 100 exemplified in FIG. 7 along the A-A' plane shown in FIG. 7. FIG. 10B illustrates a cross-sectional view of an embodiment of the reclosure label 100 exemplified in FIG. 7 along the B-B' plane shown in FIG. 7.

In comparison with the exemplary structure shown in FIG. 9A, the exemplary reclosure label 100 shown in FIG. 10A includes a segregated portion 1002 of the one or more rigid material layers 112 and/or first adhesive layers 300 instead of a gap (e.g., represented by "G2" in FIG. 9A). As shown in FIG. 10A, the segregated portion 1002 of the one or more rigid material layers 112 and/or first adhesive layers 300 can be defined by cut lines 106, which can extend through the one or more rigid material layers 112 and/or first adhesive layers 300. For example, the segregated portion 1002 can be aligned with one or more openings 204 when the reclosure label 100 is fixed to a product package 200. Further, the one or more second adhesive layers 302 can adhere the segregated portion 1002 of the one or more rigid material layers 112 to the one or more flexible material layers 114.

Thereby, the segregated portion of the one or more rigid material layers 112 and/or first adhesive layers 300 can be a part of the flap portion 104. For example, the cut lines 106 can enable the segregated portion 1002 to move freely from the adjacent portions of the label base 102 when the flap portion 104 is moved (e.g., pulled by the distal end 110) to the open orientation. At least because the segregated portion 1002 is adhered to, and thereby a part of, the flap portion 104 (e.g., which can comprise a portion of the flexible material layer 114 extending from the hinge portion 108 to the distal end 110); the one or more rigid material layers 112 of the segregated portion 1002 can enhance the rigidity of the flap portion 104. With enhanced rigidity, a shape of the flap portion 104 can be more easily maintained during operation of the reclosure label 100. As shown in FIG. 10B the one or more one or more cut lines 106, and thereby the segregated portion 1002, can extend along the length (e.g., along the "X" axis) of the reclosure label 100 and traverse the B-B' plane. In various embodiments, can define an area for the segregated portion 1002 that is greater than an area of the one or more openings 204. In various embodiments, the shape and/or size of the segregated portion 1002 can depend on the shape and/or size of the one or more openings 204 and/or a function of the reclosure label 100.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the terms "example" and/or "exemplary" are utilized to mean serving as an example, instance, or illustration. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

It is, of course, not possible to describe every conceivable combination of components, products and/or methods for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim. The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A reclosure label, comprising:

a flexible material layer comprised within a flap portion of the reclosure label and a label base of the reclosure label, wherein a portion of the flexible material layer forms a hinge between the flap portion and label base;

a rigid material layer having a first surface adhered to the flexible material layer within the label base; and a release layer positioned between the flexible material layer and the rigid material layer within the hinge.

2. The reclosure label of claim 1, wherein the rigid material layer has a second surface at least partially coated with an adhesive and permits fixation of the reclosure label to a package.

3. The reclosure label of claim 2, wherein the rigid material layer comprises a first portion comprised within the flap portion and a second portion comprised within the label base, and wherein the first portion and the second portion are separated by a defined distance based on an opening in the package.

4. The reclosure label of claim 2, wherein the first surface of the rigid material layer is further adhered to the flexible material layer within a portion of the flap portion.

5. The reclosure label of claim 4, further comprising a cut in the rigid material layer that defines a boundary of the portion of the rigid material layer adhered to the flexible material layer within the portion of the flap portion.

6. The reclosure label of claim 2, wherein the reclosure label is positioned on the package to permit the flap portion to pivot away from one or more openings of the package.

7. The reclosure label of claim 1, wherein the release layer comprises at least one member selected from the group consisting of silicone, an ultraviolet coating, a release coating.

8. The reclosure label of claim 1, wherein the release layer positioned between the flexible material layer and the rigid material layer within the hinge is also positioned between the flexible material layer of the flap portion and the rigid material layer of the label base.

9. The reclosure label of claim 1, wherein the rigid material layer comprises at least one member selected from the group consisting of polystyrene, polyester, polypropylene.

10. The reclosure label of claim 1, wherein the flexible material layer comprises at least one member selected from the group consisting of polyethylene, polyester, polypropylene.

11. The reclosure label of claim 1, wherein a distal end of the first side of the flexible material layer is free of adhesive.

12. The reclosure label of claim 1, wherein the rigid material layer has greater rigidity than the flexible material layer.

13. A reclosure label, comprising:

a flexible material layer comprised within a flap portion of the reclosure label and a label base of the reclosure label, wherein a portion of the flexible material layer forms a hinge between the flap portion and label base;

a rigid material layer having a first surface adhered to the flexible material layer within the label base; and a release layer positioned between the flexible material layer and the rigid material layer within the flap portion.

14. The reclosure label of claim 13, wherein the rigid material layer has a second surface at least partially coated with an adhesive and permits fixation of the reclosure label to a package.

15. The reclosure label of claim 14, wherein the rigid material layer comprises a first portion comprised within the flap portion and a second portion comprised within the label base, and wherein the first portion and the second portion are separated by a defined distance based on an opening in the package.

16. The reclosure label of claim 14, wherein the first surface of the rigid material layer is further adhered to the flexible material layer within a portion of the flap portion.

17. The reclosure label of claim 16, further comprising a cut in the rigid material layer that defines a boundary of the portion of the rigid material layer adhered to the flexible material layer within the portion of the flap portion.

18. The reclosure label of claim 14, wherein the reclosure label is positioned on the package to permit the flap portion to pivot away from one or more openings of the package.

19. The reclosure label of claim 13, wherein a distal end of the first side of the flexible material layer is free of adhesive.

20. The reclosure label of claim 13, wherein the rigid material layer comprises at least one member selected from a group consisting of polystyrene, polyester, polypropylene.

* * * * *